US008919715B2

(12) United States Patent
Terada

(10) Patent No.: US 8,919,715 B2
(45) Date of Patent: Dec. 30, 2014

(54) FOLDING-TYPE SHELF HOLDER

(75) Inventor: Masao Terada, Tokyo (JP)

(73) Assignee: Sugatsune Kogyo Co., Ltd., Tokyo (JP)

( * ) Notice: Subject to any disclaimer, the term of this patent is extended or adjusted under 35 U.S.C. 154(b) by 292 days.

(21) Appl. No.: 13/143,833

(22) PCT Filed: Jan. 22, 2010

(86) PCT No.: PCT/JP2010/050791

§ 371 (c)(1),
(2), (4) Date: Jul. 8, 2011

(87) PCT Pub. No.: WO2010/092864

PCT Pub. Date: Aug. 19, 2010

(65) Prior Publication Data

US 2011/0266403 A1 Nov. 3, 2011

(30) Foreign Application Priority Data

Feb. 10, 2009 (JP) ..... 2009-028668

(51) Int. Cl.

| | |
|---|---|
| ***A47G 29/02*** | (2006.01) |
| ***E04G 3/20*** | (2006.01) |
| ***A47F 5/00*** | (2006.01) |
| ***A47B 96/02*** | (2006.01) |
| ***A47B 96/06*** | (2006.01) |
| ***A47B 96/00*** | (2006.01) |

(52) U.S. Cl.

CPC ..... *A47B 96/028* (2013.01); *A47B 96/061* (2013.01); *A47B 96/00* (2013.01)

USPC ..... 248/235; 248/239; 248/240; 248/240.1; 248/240.4; 248/250; 248/240.3; 248/247; 248/248; 248/240.2; 248/242; 248/243; 248/244; 248/245; 248/238; 248/298.1; 248/291.1; 108/2; 108/115; 108/128; 108/136; 211/90.02; 211/135; 211/153

(58) Field of Classification Search

USPC ..... 248/235, 239, 240, 240.1, 461, 240.4, 248/241, 308, 155.4, 250, 240.3, 247, 248, 248/240.2, 242–246, 238, 291.1, 298.1; 211/144, 149, 150, 119.003, 134, 211/90.02, 135, 153, 90; 108/2, 115, 128, 108/136

See application file for complete search history.

(56) References Cited

U.S. PATENT DOCUMENTS 742,330 A * 10/1903 Keil ..... 248/245
1,347,116 A * 7/1920 Morgan ..... 248/240.4

(Continued)

FOREIGN PATENT DOCUMENTS

JP 17-14883 12/1942
JP 55-13840 1/1980

(Continued)

OTHER PUBLICATIONS

International Search Report, PCT/JP2010/050791, Feb. 23, 2010.

*Primary Examiner* — Christopher Garft
(74) *Attorney, Agent, or Firm* — Young & Thompson

(57) ABSTRACT

A folding shelf holder is strong and folds easily. A wall side member has a pin as a rotational axis of a shelf side member relative to the wall side member and a rotation limiter limiting rotation of the shelf side member relative to the wall side member. The shelf side member has a long groove for inserting the pin of the wall side member. When the folded shelf side member is opened to be approximately orthogonal to the wall side member and the shelf side member is slid toward the wall side member and in a direction where the long groove extends, the shelf side member abuts, at a back side of the pin, to the rotation limiter of the wall side member, preventing rotation of the shelf side member relative to the wall side member. Then, the shelf side member cannot fold relative to the wall side member.

5 Claims, 10 Drawing Sheets

(56) References Cited

U.S. PATENT DOCUMENTS

| | | | | | |
|---|---|---|---|---|---|
| 1,754,501 | A * | 4/1930 | Covell | 248/240.1 |
| 1,892,687 | A * | 1/1933 | Teufel | 211/99 |
| 2,835,522 | A * | 5/1958 | Serto | 16/390 |
| 3,463,433 | A * | 8/1969 | Coe et al. | 248/242 |
| 3,561,713 | A * | 2/1971 | Berkowitz | 248/242 |
| 3,795,379 | A * | 3/1974 | Gray | 248/242 |
| 4,448,380 | A * | 5/1984 | Huber-Krattiger | 248/235 |
| 4,927,107 | A * | 5/1990 | Mateo Maria | 248/240.4 |
| 5,816,419 | A * | 10/1998 | Lamson | 211/150 |
| 6,273,172 | B1 * | 8/2001 | Frey | 160/67 |
| 6,837,467 | B2 * | 1/2005 | Cheng | 248/240 |
| 7,472,876 | B2 * | 1/2009 | Jones | 248/242 |
| 8,152,258 | B2 * | 4/2012 | Kang et al. | 312/408 |
| 8,267,017 | B1 * | 9/2012 | Michael et al. | 108/42 |

FOREIGN PATENT DOCUMENTS

| | | |
|---|---|---|
| JP | 61-202250 | 12/1986 |
| JP | 7000243 | 1/1995 |
| JP | 11-346857 | 12/1999 |
| JP | 2008-245952 | 10/2008 |

* cited by examiner

FOLDING-TYPE SHELF HOLDER

TECHNICAL FIELD

The present invention relates to a folding-type shelf holder for supporting a shelf plate mounted on a wall in a horizontal position.

BACKGROUND ART

The folding-type shelf holder has a wall side member that is secured to a wall by screws or the like and a shelf side member that is secured to a shelf plate by screws or the like. The shelf holder is approximately L shaped as a whole. The wall side member and the shelf side member are both elongated straightly and the shelf side member is kept approximately orthogonal to the wall side member. The wall side member and the shelf side member are rotatably connected to each other at respective longitudinal ends. When the folding-type shelf holder is in a used state, the shelf side member is kept approximately orthogonal to the wall side member. And, when the folding-type shelf holder is not in the used state, the shelf side member is folded to be approximately in parallel to the wall side member. As the shelf side member is folded in the non-used state, it is possible to prevent the shelf plate from jutting out the wall and to allow effective use of space.

The patent document 1 mentioned below discloses a conventional folding-type shelf holder in which a wall side member and a shelf side member are pivotably connected to each other with a pin. The shelf side member is provided with a slide member that is slidable in the longitudinal direction. While the shelf side member is folded and rotated to be approximately orthogonal to the wall side member, the slide member is slid to the wall side member to be engaged with a holding part of the wall side member. Then, the shelf side member can be kept approximately orthogonal to the wall side member in the used state.

The patent document 2 discloses a folding-type shelf holder having a wall side member and a shelf side member, in which a long groove extending in a horizontal direction is formed in a guide plate at the upper end of the wall side member and a pin is provided on the shelf side member to be fit in the long groove. The shelf side member in a folded state is opened to be approximately orthogonal to the wall side member, the pin of the shelf side member is pushed into back of the long groove of the guide plate of the wall side member and the pin is secured to the wall side member with screws. Accordingly, the shelf side member can be kept approximately orthogonal to the wall side member in the used state.

CITATION LIST

Patent Literature

PL1: Japanese Patent Application Laid-Open No. 2008-245952

PL2: Japanese Patent Application Laid-Open No. 7-243

SUMMARY OF INVENTION

Technical Problem

The shelf holder structurally needs to have adequate strength to bear a moment load of the shelf plate. This is because it needs to support the load of the shelf plate like a cantilever beam. However, in the shelf holder disclosed in the patent document 1, the slide member provided on the shelf side member bears the moment load, and therefore, the slide member, as well as the wall side member and the shelf side member, need to have high strength.

In the shelf holder disclosed in the patent document 2, the pin is secured only by the screws and the strength cannot be said to be enough. Accordingly, it is required to provide linking arms between the shelf side member and the wall side member in a diagonal bracing manner. Besides, in order to secure the pin with the screws, the pin needs to be moved to the back of the long groove, which causes problems of troublesome operation and difficulty in changing the shelf holder into the folded state or used state with ease.

The present invention was carried out in order to solve such problems of the conventional folding-type shelf holders. The present invention provides a folding-type shelf holder capable of ensuring its adequate strength when it is used and also of changing the shape into a folded state or used state easily.

Solution to Problem

In order to solve the above-mentioned problems, a first aspect of the present invention is a folding-type shelf holder comprising a wall side member mounted on a wall and a shelf side member mounted on a shelf plate, the folding-type shelf holder changing from a folded state where the shelf side member is folded relative to the wall side member to a used state where the shelf side member is approximately orthogonal to the wall side member, wherein the wall side member has a pin as an axis of rotation of the shelf side member relative to the wall side member and a rotation limiter for limiting rotation of the shelf side member relative to the wall side member, the shelf side member has a long groove for insertion of the pin of the wall side member, when the shelf side member in the folded state is opened to be approximately orthogonal to the wall side member and the shelf side member is slid toward the wall side member and in a direction where the long groove extends, a part of the shelf side member behind the pin comes into contact with the rotation limiter of the wall side member so as to prevent rotation of the shelf side member relative to the wall side member and the shelf side member becomes unable to be folded relative to the wall side member, and when the shelf side member that is unable to be folded is slid in a direction away from the wall side member, the shelf side member becomes able to rotate relative to the wall side member and thereby to be folded relative to the wall side member.

A second aspect of the present invention is characterized in that, in the folding-type shelf holder of the first aspect, the shelf side member has a blade spring that is engageable with the pin of the wall side member, and when the shelf side member in the folded state is opened to be approximately orthogonal to the wall side member and the shelf side member is slid toward the wall side member and in the direction where the long groove extends, the blade spring engages with the pin and the shelf side member is temporarily fixed to the wall side member.

A third aspect of the present invention is characterized in that, in the folding-type shelf holder of the first aspect, the wall side member has a lock member that is slidable in a longitudinal direction of the wall side member, when the lock member is slid toward the shelf side member, the lock member engages with the shelf side member to prevent the shelf side member from being pulled out of the wall side member, and when the lock member is slid in a direction away from the shelf side member, the lock member gets out of engagement with the shelf side member.

A fourth aspect of the present invention is characterized in that, in the folding-type shelf holder of the third aspect, the shelf side member has a stay that is integrally formed by bending and engages with the lock member.

Advantageous Effects of Invention

According to the invention of the first aspect, as the pin is provided in the wall side member as the axis of rotation of the shelf side member and the long groove is provided in the shelf side member for insertion of the pin, it is possible to increase the distance from the pin as the axis of rotation of the shelf side member to the abutting point between the shelf side member and the wall side member (point of action) by sliding the shelf side member toward the wall side member. Accordingly, from the principle of leverage, it becomes possible to bear, at the abutting point, a vertical load (power point) of the shelf plate positioned at the opposite side of the axis to the abutting point by a small force, thereby increasing the strength of the shelf holder. Further, as the narrow long groove is provided in the shelf side member in the direction where the shelf side member extends, not only the shelf side member but also the long groove for insertion of the pin is oriented downward. Therefore, it becomes possible to prevent the shelf side member from rattling horizontally relative to the pin.

According to the invention of the second aspect, it is possible to know that the shelf holder is in the used state by feeling the blade spring of the shelf side member engaged with the pin of the wall side member. Besides, as the pin of the wall side member is also used for temporary fixation, the structure of the shelf holder can be simplified.

According to the invention of the third aspect, as the temporarily fixed shelf side member can be locked, the shelf side member in the used state can be stabilized. As the shelf side member is temporarily fixed in advance and the shelf side member can be locked without use of a tool such as a driver, the operation of locking the shelf side member can be facilitated.

According to the invention of the fourth aspect, the stay can be easily formed only by bending the shelf side member.

DESCRIPTION OF EMBODIMENTS

Figure 1:
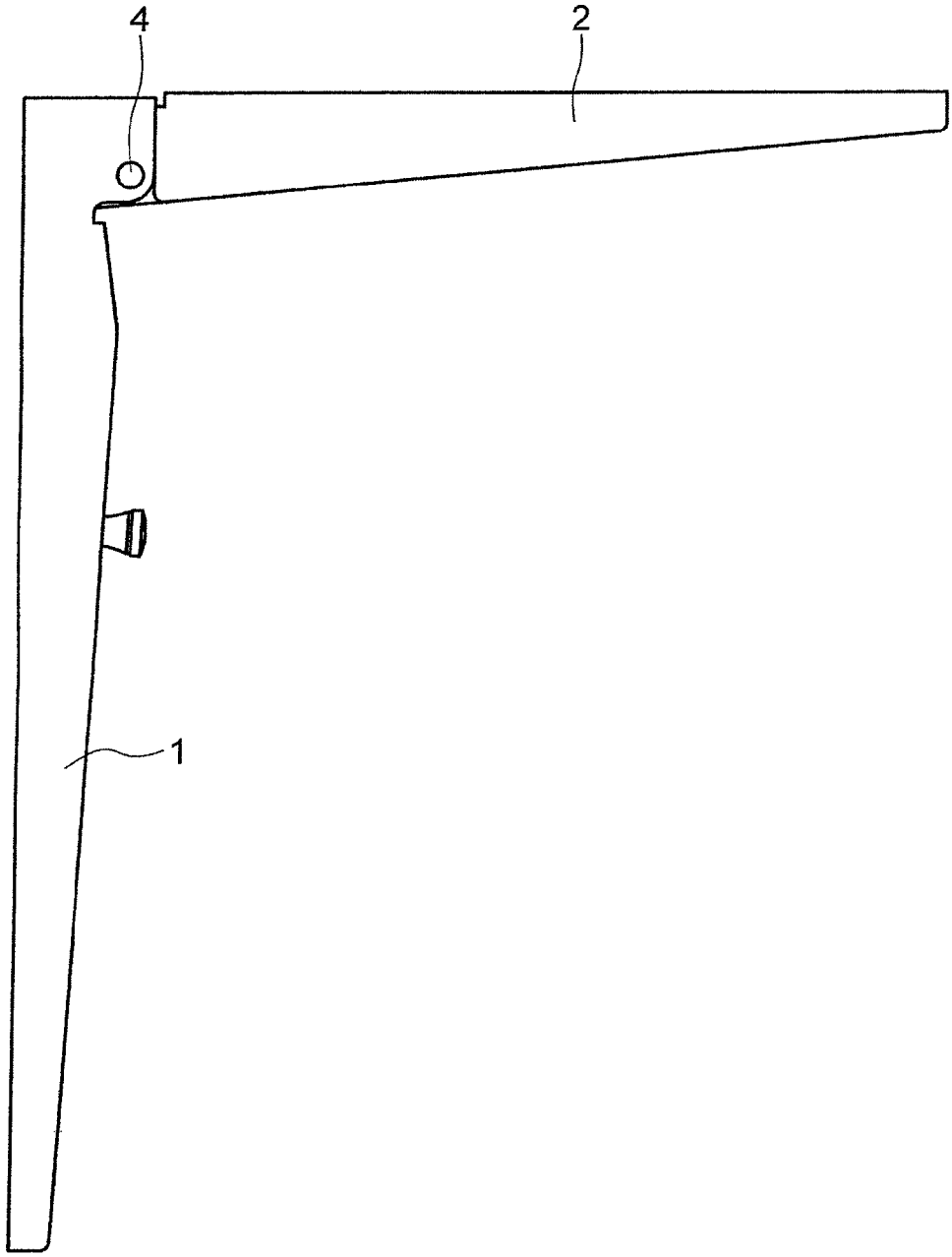
FIG. 1 is a front view of a folding-type shelf holder according to a first embodiment of the present invention (used state)
Figure 2:
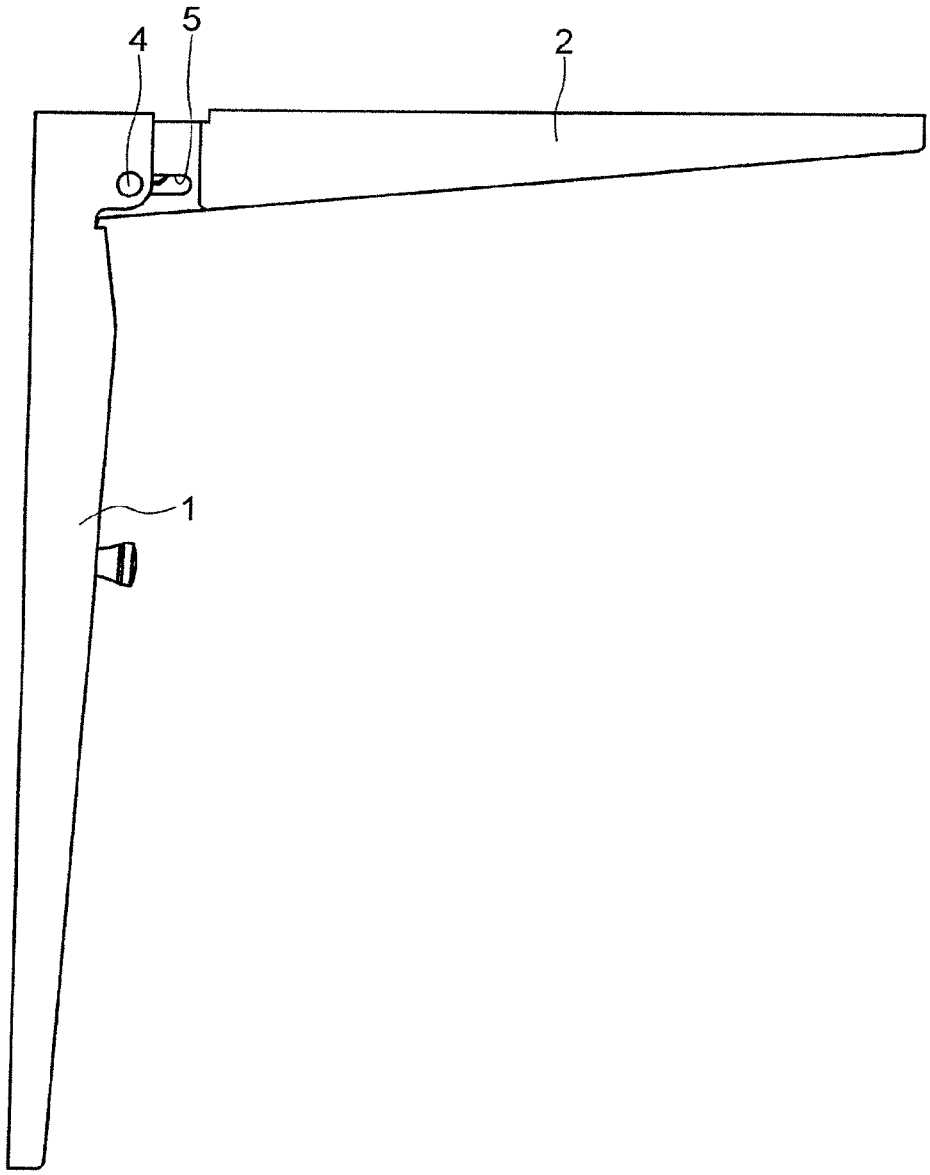
FIG. 2 is a front view of the shelf holder when the shelf side member is pulled out.
Figure 3:
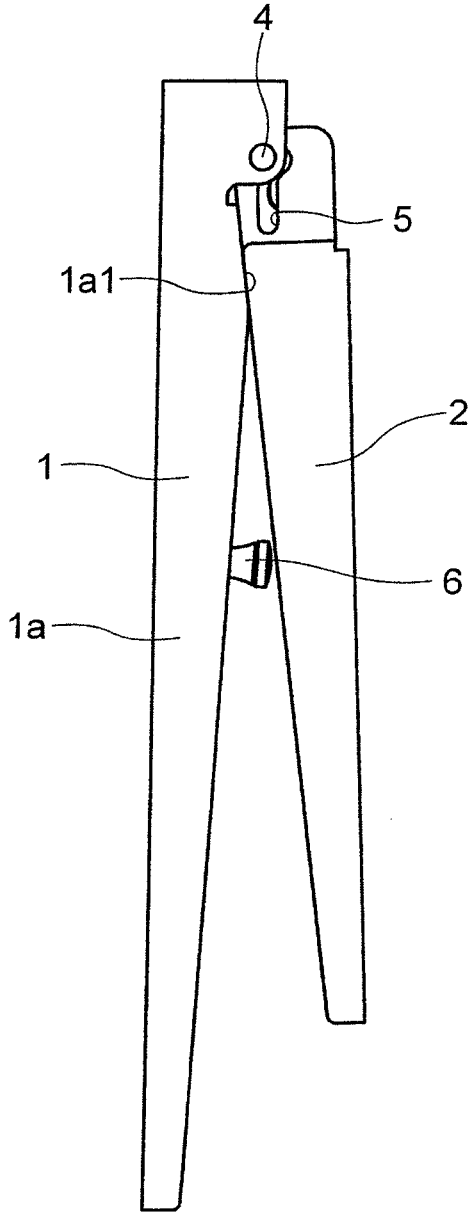
FIG. 3 is a front view of the shelf holder in a folded state.

With reference to the attached drawings, a folding-type shelf holder according to exemplary embodiments of the present invention will be described in detail below. FIGS. 1 to 3 illustrate a folding-type shelf holder according to a first embodiment of the present invention. This folding-type shelf holder is mounted on a wall of an architectural structure or a wall (side surface) of a chair, table, desk or the like to hold a shelf plate horizontally.

FIG. 1 is a front view of the shelf holder in a used state. The shelf holder has a wall side member 1 mounted on a wall and a shelf side member 2 mounted on a shelf plate. The wall side member 1 and the shelf side member 2 are both elongated straightly. In the used state, the shelf side member 2 extends in the horizontal direction, and the wall side member 1 extends in the vertical direction. The wall side member 1 and the shelf side member 2 are connected to each other at their longitudinal ends.

FIG. 2 is a front view of the shelf holder in which the shelf side member 2 is pulled out. In the wall side member 1, a pin 4 is provided as an axis of rotation of the shelf side member 2. At a longitudinal end of the shelf side member 2, a long hole 5 is formed as a long groove for insertion of the pin 4. The long hole 5 is elongated in the direction where the shelf side member 2 extends. When the shelf side member 2 is slid in the horizontal direction and in the direction away from the wall side member 1, the long hole 5 slides along the pin 4 in its elongated direction.

FIG. 3 is a front view of the shelf holder in a folded state. After the shelf side member 2 is pulled out, it can rotate about the pin 4 and rotate downward due to its gravity. The shelf side member 2 rotates to become approximately parallel to the wall side member 1. In the folded state, the shelf side member 2 is in contact with an inclined surface 1*a*1 at the upper side of a side wall part 1*a* of the wall side member 1. Accordingly, the shelf side member 2 stops rotating immediately before it becomes completely parallel to the wall side member 1 and does not abut to a knob 6.

When changing the shelf holder from the folded state to the used state, first, the shelf side member 2 in the folded state is opened to be approximately orthogonal to the wall side member 1 (from FIG. 3 to FIG. 2). Next, the shelf side member 2 is slid toward the wall side member 1 and in the direction where the long hole 5 extends (from FIG. 2 to FIG. 1). When changing the shelf holder from the used state to the folded state, the above-described procedure is reversed. First, the shelf side member 2 in the used state is pulled out of the wall side member 1 in the horizontal direction (from FIG. 1 to FIG. 2). Next, the shelf side member 2 is rotated about the pin 4 and brought into the folded state (from FIG. 2 to FIG. 3).

Figure 4:
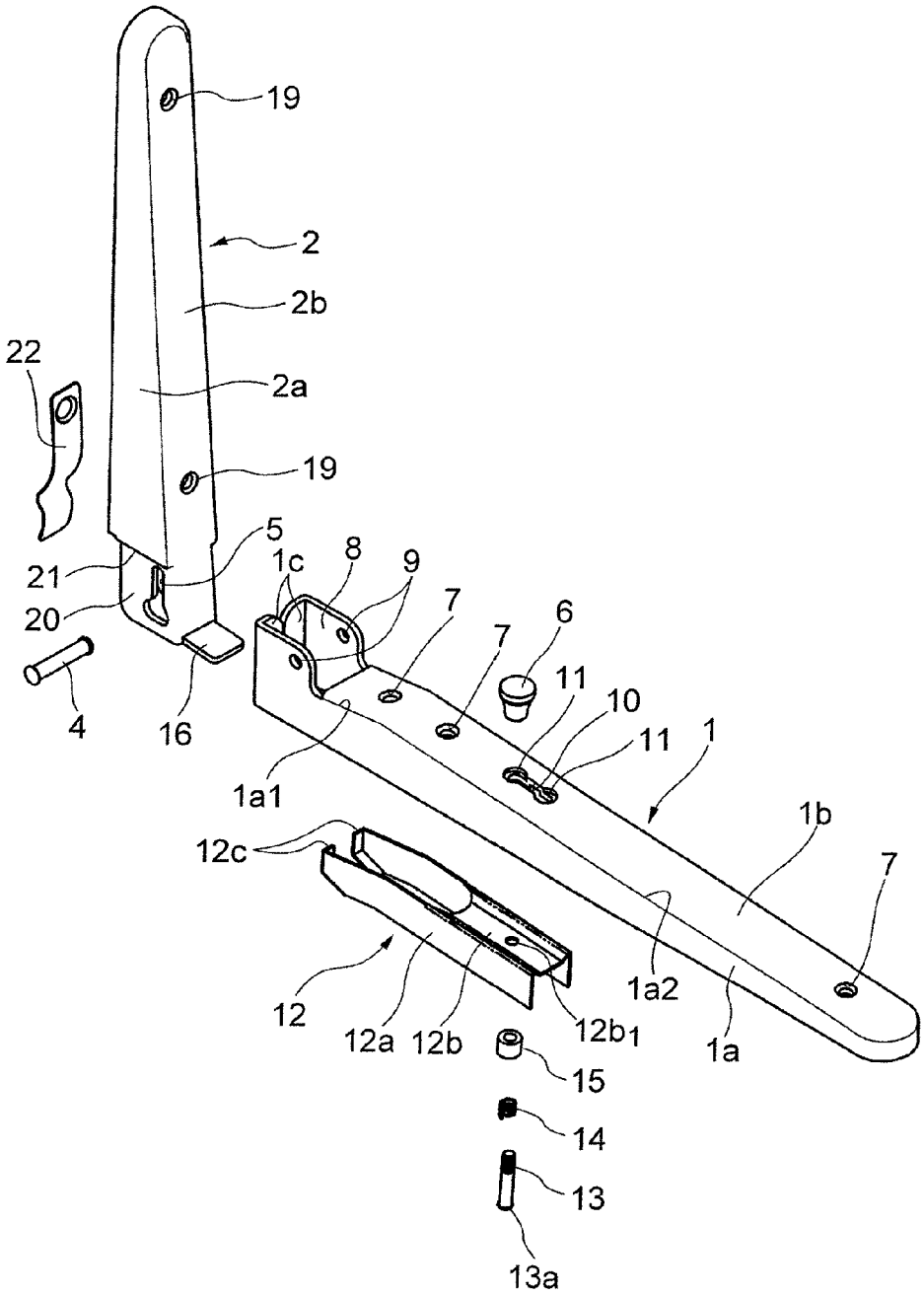
FIG. 4 is an exploded perspective view of the shelf holder.

FIG. 4 is an exploded perspective view of the shelf holder. The wall side member 1 is made of sheet metal and manufactured by bending a thin plate. The wall side member 1 has a web 1*b* and a pair of side wall parts 1*a* which stand at both side of the web 1*b* and face each other. The wall side member 1 has a U shaped cross section. In the web 1*b*, a plurality of through holes 7 is formed. A screw is made to pass through a through hole 7 from the web side and tightened up on the wall thereby to fasten a back surface of the wall side member 1 to the wall. In each side wall part 1*a*, the inclined surface 1*a*1 is formed for directing the shelf side member 2 in contact with the wall side member 1 obliquely downward (see FIG. 3). The side wall part 1*a* is most prominent at the lower end of the inclined surface 1*a*1 and becomes lower and lower toward the lower side of the wall side member 1 (in the right direction in the figure) in such a manner that the surface comes close to the wall. This surface is called inclined surface 1*a*2.

In the upper end of the wall side member 1 (left end in the figure), an opening 8 is formed for inserting the shelf side member 2. This opening 8 is defined by the paired side wall parts 1*a* facing each other, a pair of upper wall parts 1*c* provided at the upper sides of the paired side wall parts 1*a* and the cut web 1*b*. The paired upper wall parts 1*c* are formed by bending the opposite paired side wall parts 1*a* inward and function as rotation limiters for limiting rotation of the shelf side wall 2 that rotates about the pin 4. Butted surfaces of the bent paired upper wall parts 1*c* are welded so as to increase the strength.

In each of the side wall parts 1*a*, a pin insertion hole 9 is formed at the same position as each other. Between these pin insertion holes 9, the pin 4 is placed like a bridge and serves as the axis of rotation of the shelf side member 2. This pin 4 is fit in the long holes 5 of the shelf side member 2.

At the center in the longitudinal direction of the web 1*b*, a guide groove 10 is formed elongated in the longitudinal direction. At each of both ends of the guide groove 10, a recess 11 is formed that has enlarged diameter. The knob that moves along the guide groove 10 is positioned at the recess 11 at each end of the guide groove 10. On the back surface of the web 1*b*, a lock member 12 is accommodated slidably. The lock member 12 slides between the paired side wall parts 1*a*.

The lock member 12 is also made of sheet metal and has a web 12*b* and a pair of side wall parts 12*a* that stand up at both sides of the web 12*b* and face each other. In the web 12*b* of the lock member 12, a through hole 12*b*1 is formed for insertion of a pin 13 that is screwed to the knob 6: The pin 13 passes through the guide groove 10 of the wall side member 1. The web 1*b* of the wall side member 1 is sandwiched between the knob 6 and the lock member 12. Around the pin 13, a coil spring 14 is wound. The coil spring 14 is placed between a flange 13*a* of the pin 13 and a cylindrical spring bearing 15 and creates a biasing force for seating the knob 6 in the recess 11 of the guide groove 10 of the wall side member 1 (see FIG. 5).

While the knob 6 is seated in the recess 11 by the coil spring 14, the knob 6 cannot be slid along the guide groove 10. This is because the outer diameter of the knob 6 is larger than the width of the guide groove 10. On the other hand, when the knob 6 is grasped and picked up from the recess 11 against the spring force of the coil spring 14, the pin 13 that is thinner than the knob 6 can slide along the guide groove 10. Once the knob is moved to the opposite recess 11 and the knob 6 is released, the knob 6 is seated in the recess 11 again by the spring force of the coil spring 14 and is kept in this state (see FIG. 8). As the knob 6 moves, the lock member 12 slides along the wall side member 1.

The lock member 12 engages with the stay 16 of the shelf side member 2. As illustrated in FIG. 4, at the upper end of each side wall part 12*a* of the lock member 12, a malfunction preventing piece 12*c* is provided that is bent inside. When the shelf side member 2 is not fully inserted into the opening 8 of the wall side member 1, this malfunction preventing piece 12*c* acts to prevent the lock member 12 from sliding toward the shelf side member 2 as the lock member 12 abuts to the stay 16 of the shelf side member 2. Once the shelf side member 2 is fully inserted into the opening 8 of the wall side member 1, the lock member 12 can slide toward the shelf side member 2.

The shelf side member 2 is also made of sheet metal and is manufactured by bending a thin plate. The shelf side member 2 has a web 2*b* and a pair of side wall parts 2*a* that stand up at the both sides of the web 2*b* and face each other. The shelf side member 2 has a U shaped cross section. In the web 2*b*, a plurality of through holes 19 is formed. When a screw is made to pass through a through hole 19 from the lower side of the web 2*b* and tightened up on the shelf plate. Thereby, the upper surface of the shelf side member 2 is fixed to the shelf plate. The side wall parts 2*a* are tapered in such a manner that their lower surfaces are raised toward the front side of the shelf side member 2.

At the end of the shelf side member 2, an inserted part 20 is formed which is inserted in the opening 8 of the wall side member 1. In this inserted part 20, a level difference 21 is formed in the paired side wall parts 2*a* so as to narrow the width between the side wall parts 2*a*. The inserted part 20 of the shelf side member 2 is inserted into the inside of the opening 8 of the wall side member 1. In the used state, the inserted part 20 of the shelf side member 2 is inserted to the back of the opening 8 until the level difference 21 of the side wall parts 2*a* abuts to the side wall parts 1*a* that define the opening 8 of the wall side member 1. When the inserted part 20 of the shelf side member 2 is inserted into the opening 8 of the wall side member 1, the long holes 5 formed in the side wall parts 2*a* of the shelf side member 2 are hidden inside the side wall parts 1*a* of the wall side member 1. This makes it possible to improve the beauty of the shelf holder in the used state.

At the end of the web 2*b* of the shelf side member 2, the stay 16 is formed integrally by bending toward the wall side member 1. When the knob 6 is held to slide the lock member 12 toward the shelf side member 2, the stay 16 of the shelf side member 2 engages with the lock member 12 thereby to prevent the shelf side member 2 from being pulled out of the wall side member 1 (see FIG. 8). On the other hand, when the knob 6 is held to slide the lock member 12 away from the shelf side member 2, the lock member 12 gets out of engagement with the stay 16 of the shelf side member 2 thereby to be able to pull the shelf side member 2 out of the wall side member 1 (see FIG. 7).

At the side walls of the inserted part 20 of the shelf side member 2, the long holes 5 are formed extending in the longitudinal direction of the shelf side member 2. The back-side end of each long hole 5 is enlarged in width so as to fold the shelf side member 2 easily. On the web 2*b* of the shelf side member 2, a blade spring 22 is mounted that is bent in the form of waves. The blade spring 22 is fixed at one end to the web 2*b* and the other end is free (see FIG. 7). The waveform of the blade spring 22 is formed to exert a force of holding the position of the shelf side member 2 in the used state and the pulled-out state.

Figure 5:
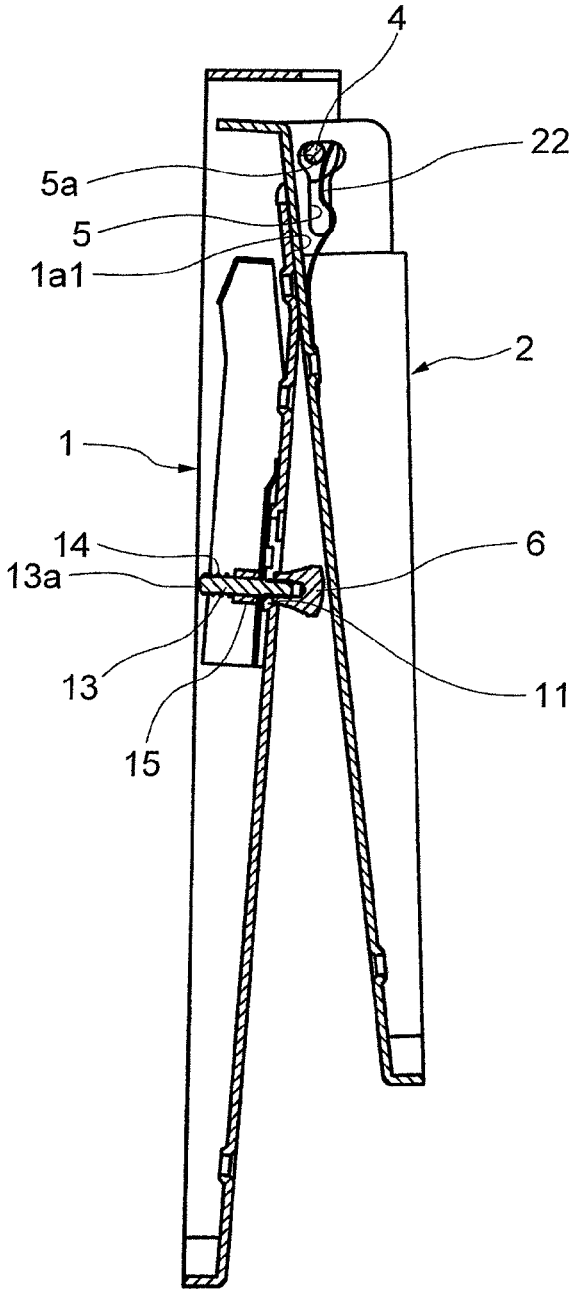
FIG. 5 is a cross sectional view of the shelf holder in the folded state.
Figure 6:
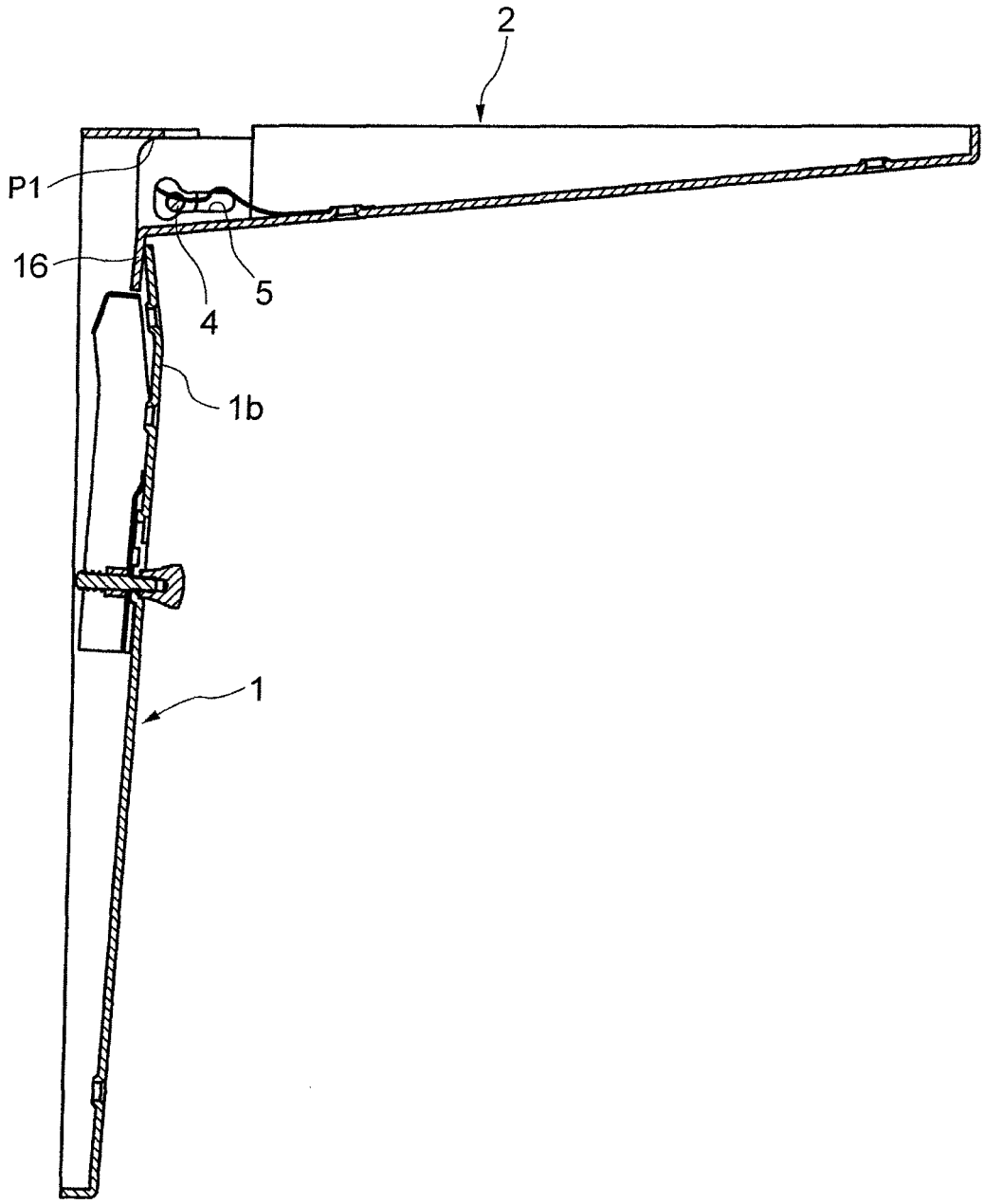
FIG. 6 is a cross sectional view of the shelf holder when the shelf side member is open to be orthogonal to the wall side member.
Figure 7:
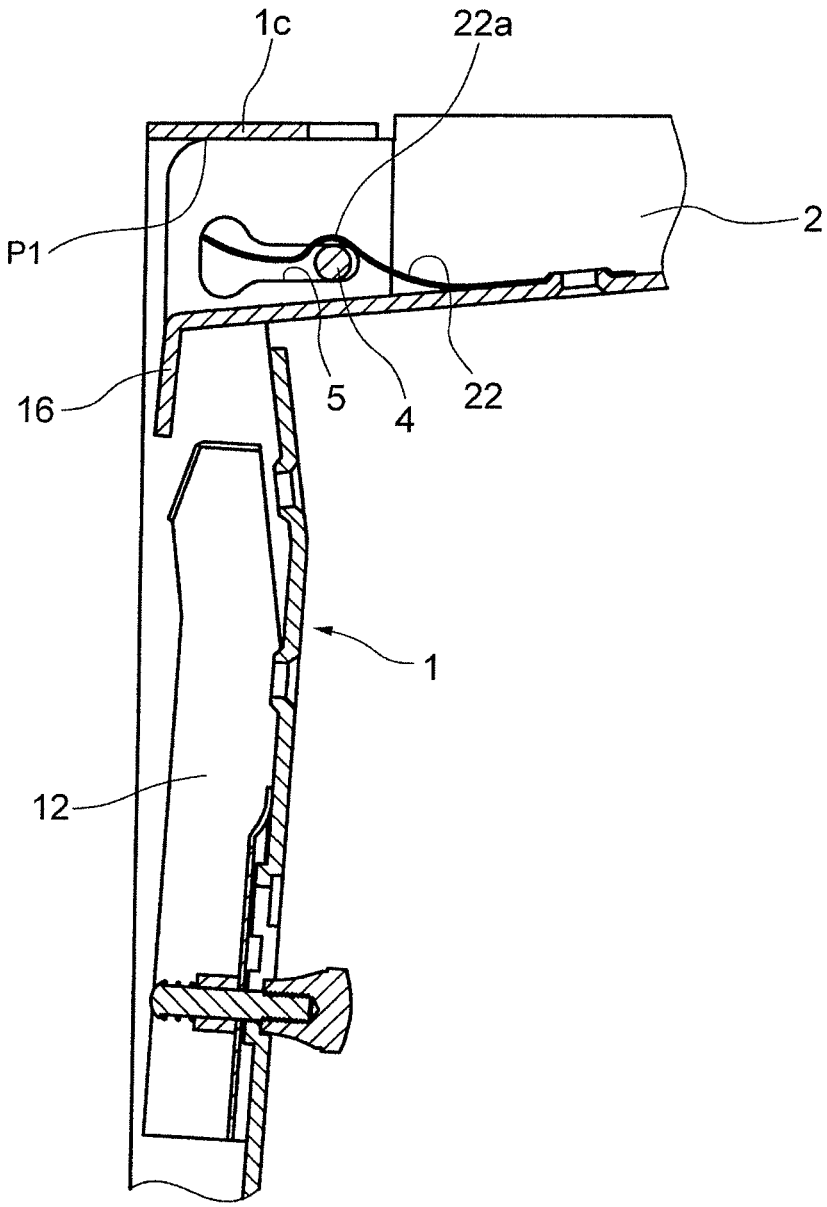
FIG. 7 is an enlarged cross sectional view of the shelf holder when the shelf side member is temporarily fixed to the wall side member.

FIGS. 5 to 7 illustrate change in cross sectional shape of the shelf holder from the folded state to the used state. In the folded state illustrated in FIG. 5, the shelf side member 2 abuts to the inclined surface 1*a*1 of the wall side member 1 and is oriented obliquely downward. Then, the long hole 5 extending in the longitudinal direction of the shelf side member 2 is oriented downward and the blade spring 22 biases the pin 4 toward the enlarged part 5*a* of the long hole 5. Accordingly, in conveying the shelf holder in the folded state, the wall side member 1 is oriented vertically upward thereby to prevent the shelf side member 2 from rattling. Here, in the folded state, the knob 6 is seated in the recess 11 at the lower side of the guide groove 10 and the lock member 12 is separated from the shelf side member 2.

As illustrated in FIG. 6, when the shelf side member 2 in the folded state is opened relative to the wall side member 1, the shelf side member 2 rotates about the pin 4 of the wall side member 1 until the stay 16 of the shelf side member 2 abuts to the web 1*b* of the wall side member 1, and the shelf side member 2 becomes approximately orthogonal to the wall side member 1.

Next, as illustrated in FIG. 7, the shelf side member 2 is slid toward the wall side member 1 and in the horizontal direction in which the long hole 5 extends. Then, the blade spring 22 is fit in the pin 4 that has moved to the right end of the long hole 5, and shelf side member 2 is temporarily fixed to the wall side member 1. This temporary fixation of the shelf side member 2 can be felt as a prominent part 22*a* at the center of the blade spring 22 is engaged with the pin 4, and the shelf side member 2 is kept temporarily fixed to the wall side member 1.

In this temporarily fixed state, the shelf side member 2 abuts, at the back side of the pin 4, to the upper wall part of the wall side member 1 so as not to rotate the shelf side member 2 relative to the wall side member 1. With this structure, the shelf side member 2 is prevented from being folded relative to the wall side member 1. The load in the vertical direction on the shelf plate is borne based on the principle of leverage where the fulcrum (axis) is the pin 4 and the point of action is the abutting point P1 of the shelf side member 2 to the upper wall part 1*c* of the wall side member 1.

Figure 8:
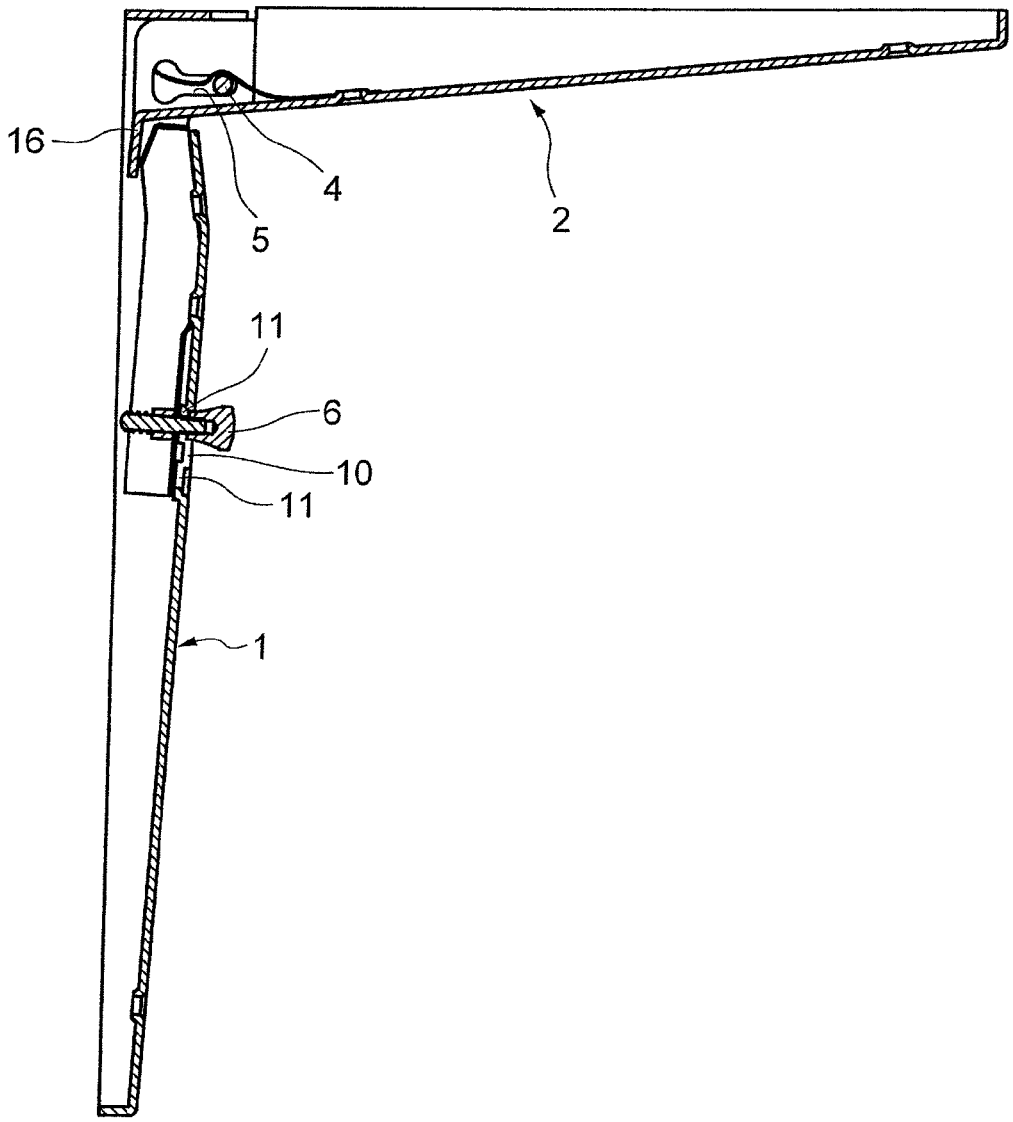
FIG. 8 is a cross sectional view of the shelf holder when the shelf side member is locked to the wall side member.

In the temporarily fixed state, the stay 16 formed integral with the shelf side member 2 is moved to the back side of the wall side member 1. Next, as illustrated in FIG. 8, when the knob 6 is moved from the lower-side recess 11 to the upper-side recess 11 of the guide groove 10 of the wall side member 1, the lock member 12 slides upward in the wall side member 1 and is engaged with the stay 16 of the shelf side member 2. In this lock state, the shelf side member 2 is prevented from being pulled out of the wall side member 1. With this procedure, the shelf side member 2 in the folded state can be changed into the used state.

When the shelf side member 2 in the used state is brought into the folded state, the following steps are taken. In the lock state, first as illustrated in FIG. 7, the lock member 12 is slid in the direction away from the shelf side member 2, and the lock member 12 comes out of engagement with the stay 16 of the shelf side member 2 so that the shelf side member 2 can be pulled out of the wall side member 1. Then, as illustrated in FIG. 6, the shelf side member 2 is slid in the direction away from the wall side member 1 along the long hole 5. The shelf side member 2 slides along the long hole 5 until the stay 16 abuts to the web 1*b* of the wall side member 1. With this structure, the distance from the pin 4 as the axis of rotation to the abutting point P1 of the shelf side member 2 becomes short and the shelf side member 2 becomes able to rotate relative to the wall side member 1. In other words, the shelf side member 2 becomes able to be folded relative to the wall side member 1. Next, as illustrated in FIG. 5, the shelf side member 2 is rotated until the shelf side member 2 abuts to the inclined surface 1*a*1 of the wall side member 1. After this rotation, the shelf side member 2 becomes in the folded state.

Figure 9:
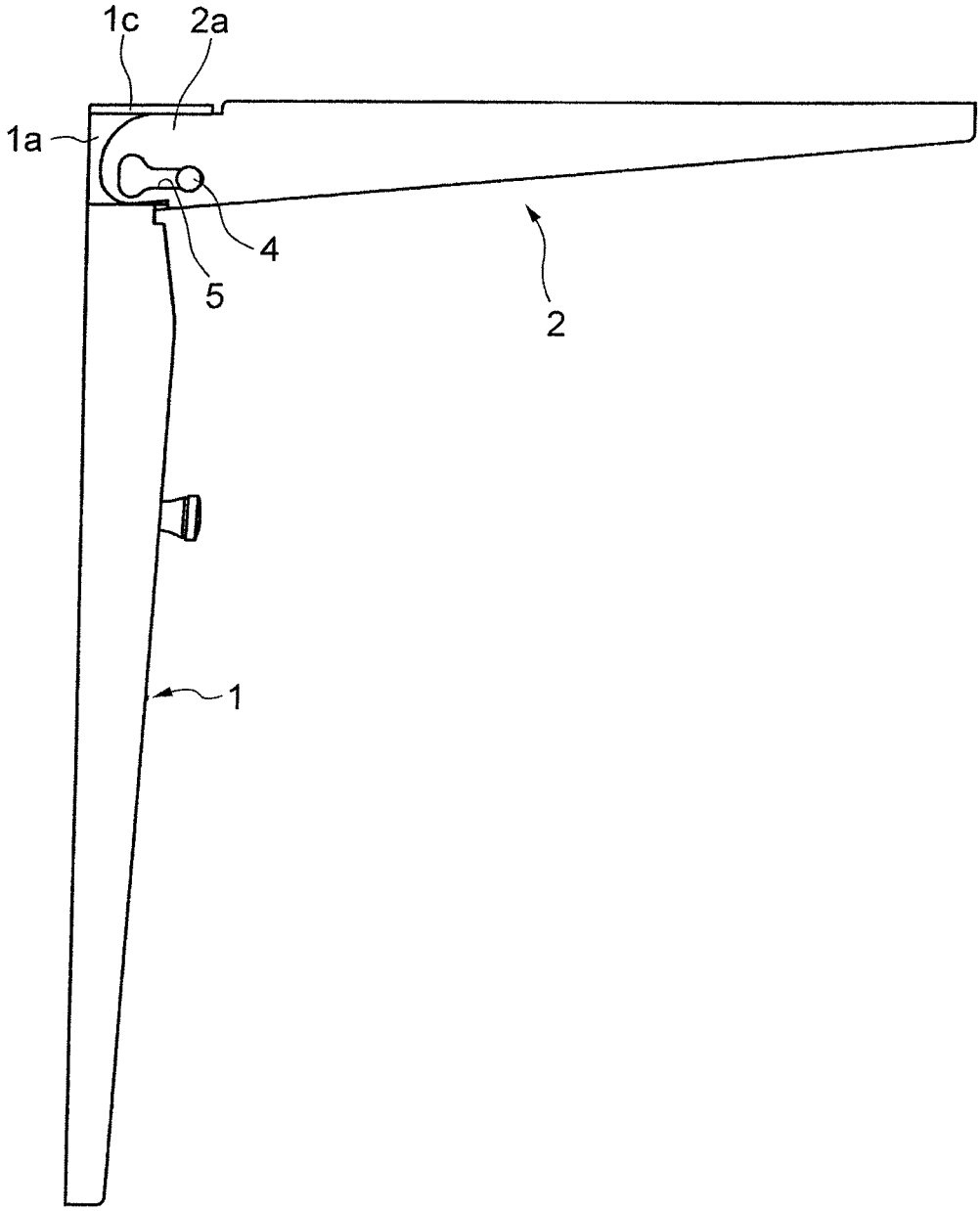
FIG. 9 is a front view of a shelf holder according to a second embodiment of the present invention (used state)
Figure 10:
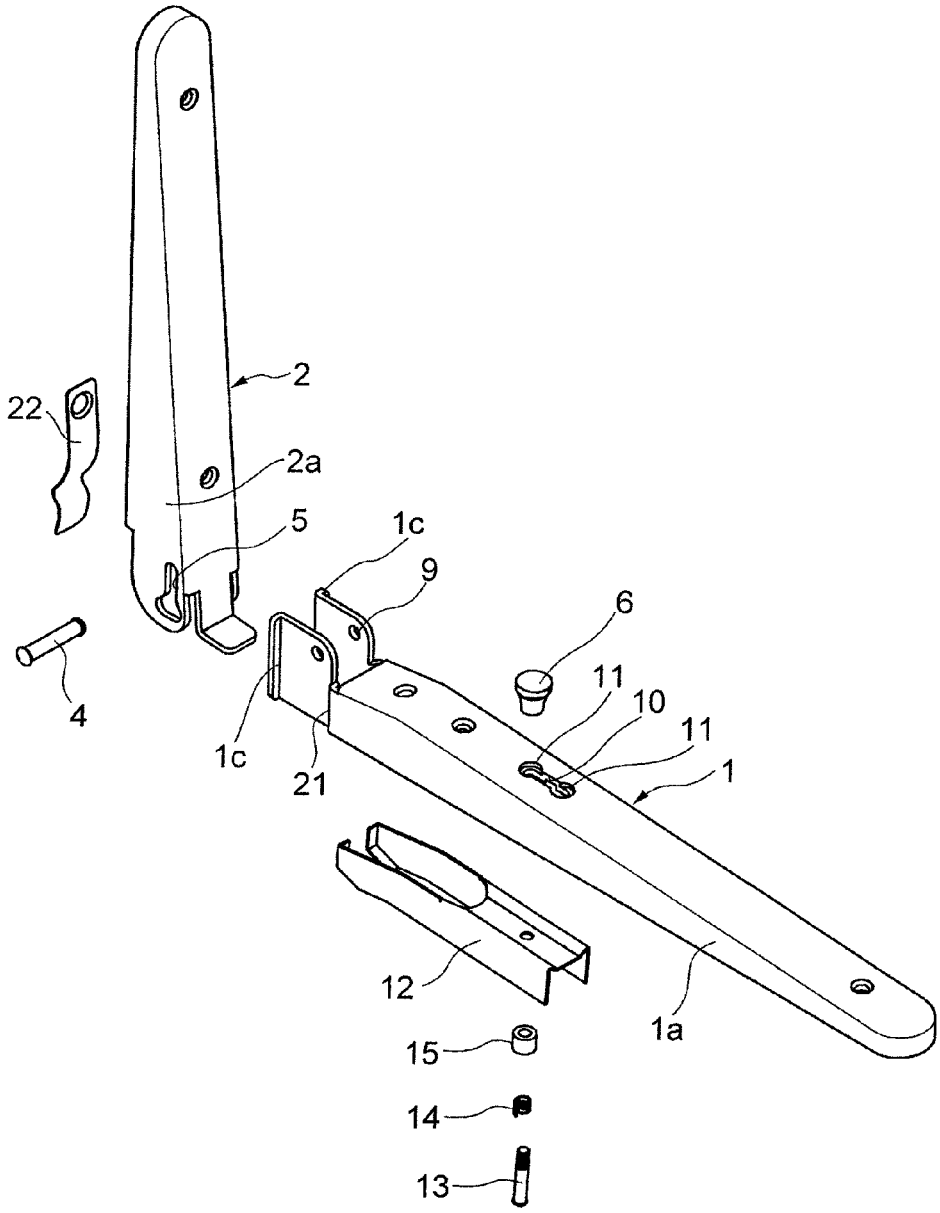
FIG. 10 is an exploded perspective view of the shelf holder according to the second embodiment of the present invention.

FIG. 9 illustrates a shelf holder according to a second embodiment of the present invention. The side wall part 2*a* of the shelf side member 2 according to this embodiment is fit in the outside of the side wall part 1*a* of the wall side member 1. As illustrated in the exploded perspective view of FIG. 10, there is no level difference in the side wall parts 2*a* of the shelf side member 2 and a level difference 21 is formed in the side wall parts 1*a* of the wall side member 1 so as to narrow the width between the paired side wall parts 1*a*. At the upper part of each side wall part 1*a* of the wall side member 1, an upper wall part 1*c* is formed that is bent to the outside. This upper wall part 1*c* serves as a rotation limiter for limiting rotation of the shelf side member 2 about the pin 4. Instead of the upper wall part 1*c*, a pin may be placed as a bridge between the paired side wall parts 1*a* so that the pin can abut to the shelf side member 2. The fundamental structures and operations of the shelf side member 2 and the wall side member 1 are the same as those in the above-described first embodiment. Therefore, the like parts are denoted by the like reference numerals and description thereof is omitted here.

The present invention is not limited to the above-described embodiments and may be embodied in various forms without departing the scope of the present invention. For example, the cross sectional shapes of the wall side member and the shelf side member may be modified in various shapes as far as the pin is provided in the wall side member and the long groove is provided in the shelf side member. The long groove needs not to be a long hole with the both longitudinal ends closed and may be a groove with free ends. In order to improve the strength of the shelf holder more, a linking arm may be provided between the shelf side member and the wall side member for bearing a moment load of the shelf plate.

The present specification is based on Japanese Patent Applications No. 2009-028668 filed on Feb. 10, 2009, the entire contents of which are expressly incorporated by reference herein.

REFERENCE NUMERALS

1 . . . wall side member
1*c* . . . upper wall part (rotation limiter)
2 . . . shelf side member
4 . . . pin
5 . . . long hole (long groove)
12 . . . lock member
16 . . . stay

The invention claimed is:

1. A foldable shelf holder, comprising:

a wall side member mountable on a wall and a shelf side member mountable on a shelf plate, the foldable shelf holder changing from a folded state where the shelf side member is folded relative to the wall side member to a used state where the shelf side member is approximately orthogonal to the wall side member, wherein the wall side member has a pin as an axis of rotation of the shelf side member relative to the wall side member and a rotation limiter for limiting rotation of the shelf side member relative to the wall side member, the shelf side member has a long groove which extends in a direction where the shelf side member extends for insertion of the pin of the wall side member, when the shelf side member is slid toward the wall side member in a direction where the long groove extends so that the pin moves in one end of the long groove, a distance from the pin as an axis of rotation of the shelf side member to an abutting portion of the shelf side member behind the pin increases and the abutting portion of the shelf side member behind the pin comes into contact with the rotation limiter of the wall side member so as to prevent rotation of the shelf side member relative to the wall side member and the shelf side member becomes unable to be folded relative to the wall side member, when the shelf side member is slid in a direction away from the wall side member so that the pin moves in another end of the long groove, the distance from the pin as an axis of rotation of the shelf side member to the abutting portion of the shelf side member behind the pin decreases and the shelf side member becomes able to rotate relative to the wall side member and thereby to be folded relative to the wall side member, the wall side member has a web and a pair of side wall parts, the side wall parts standing at opposing width sides of the web and facing each other, and a cross section of the web and the pair of side wall parts defines a U shape, the wall side member has a pair of upper wall parts, each of the upper wall parts respectively located at a longitudinal end of a corresponding one of the side wall parts, each upper wall part being connected to the corresponding one side wall part via a bend in the corresponding one side wall part and being located inwardly or outwardly of the corresponding one side wall part, and the pair of upper wall parts functions as the rotation limiter.

2. A foldable shelf holder comprising a wall side member mountable on a wall and a shelf side member mountable on a shelf plate, the foldable shelf holder changing from a folded state where the shelf side member is folded relative to the wall side member to a used state where the shelf side member is approximately orthogonal to the wall side member, wherein the wall side member has a pin as an axis of rotation of the shelf side member relative to the wall side member and a rotation limiter for limiting rotation of the shelf side member relative to the wall side member, the shelf side member has a long groove which extends in the direction where the shelf side member extends for insertion of the pin of the wall side member, when the shelf side member is slid toward the wall side member in a direction where the long groove extends so that the pin moves in one end of the long groove, a distance from the pin as an axis of rotation of the shelf side member to an abutting portion of the shelf side member behind the pin increases and the abutting portion of the shelf side member behind the pin comes into contact with the rotation limiter of the wall side member so as to prevent rotation of the shelf side member relative to the wall side member and the shelf side member becomes unable to be folded relative to the wall side member, when the shelf side member is slid in a direction away from the wall side member so that the pin moves in another end of the long groove, the distance from the pin as an axis of rotation of the shelf side member to the abutting portion of the shelf side member behind the pin decreases and the shelf side member becomes able to rotate relative to the wall side member and thereby to be folded relative to the wall side member, the shelf side member has a blade spring that is engageable with the pin of the wall side member, and when the shelf side member is slid toward the wall side member and in the direction where the long groove extends so that the pin moves in one end of the long groove, the blade spring engages with the pin and the shelf side member is temporarily fixed to the wall side member.

3. The foldable shelf holder of claim 1, wherein the wall side member has a lock member that is slidable in a longitudinal direction of the wall side member, when the lock member is slid toward the shelf side member, the lock member engages with the shelf side member to prevent the shelf side member from being pulled out of the wall side member, and when the lock member is slid in a direction away from the shelf side member, the lock member gets out of engagement with the shelf side member.

4. The foldable shelf holder of claim 3, wherein the shelf side member has a stay that is integrally formed at a bend at an end of the web of the shelf side member and engages with the lock member.

5. A foldable shelf holder comprising a wall side member mountable on a wall and a shelf side member mountable on a shelf plate, the foldable shelf holder changing from a folded state where the shelf side member is folded relative to the wall side member to a used state where the shelf side member is approximately orthogonal to the wall side member, wherein the wall side member has a pin as an axis of rotation of the shelf side member relative to the wall side member and a rotation limiter for limiting rotation of the shelf side member relative to the wall side member, the shelf side member has a long groove which extends in the direction where the shelf side member extends for insertion of the pin of the wall side member, when the shelf side member is slid toward the wall side member in a direction where the long groove extends so that the pin moves in one end of the long groove, a distance from the pin as an axis of rotation of the shelf side member to an abutting portion of the shelf side member behind the pin increases and the abutting portion of the shelf side member behind the pin comes into contact with the rotation limiter of the wall side member so as to prevent rotation of the shelf side member relative to the wall side member and the shelf side member becomes unable to be folded relative to the wall side member, when the shelf side member is slid in a direction away from the wall side member so that the pin moves in another end of the long groove, the distance from the pin as an axis of rotation of the shelf side member to the abutting portion of the shelf side member behind the pin decreases and the shelf side member becomes able to rotate relative to the wall side member and thereby to be folded relative to the wall side member, the wall side member has a web and a pair of side wall parts, the side wall parts standing at opposing width sides of the web and facing each other, and a cross section of the web and the pair of side wall parts defines a U shape, the pair of side wall parts facing each other defines an opening of the wall side member, the shelf side member has a web and a pair of side wall parts, the side wall parts of the shelf side member standing at width sides of the web of the shelf member and facing each other, and a cross section of the web and the pair of side wall parts of the shelf side member defines a U shape, an inserted part is formed at a longitudinal end of the shelf side member, the inserted part being inserted in the opening of the wall side member, the inserted part of the shelf side member has a level difference so as to narrow a width between the pair of the side wall parts of the shelf side member, and with the inserted part of the shelf side member being inserted into the opening of the wall side member, the long grooves formed in the side wall parts of the shelf side member hide behind the side wall parts of the wall side member.

* * * * *